US007114999B2

(12) United States Patent
Tsuji

(10) Patent No.: US 7,114,999 B2
(45) Date of Patent: Oct. 3, 2006

(54) CONNECTOR AND A CONNECTOR ASSEMBLY

(75) Inventor: Takeshi Tsuji, Yokkaichi (JP)

(73) Assignee: Sumitomo Wiring Systems, Ltd., (JP)

( * ) Notice: Subject to any disclaimer, the term of this patent is extended or adjusted under 35 U.S.C. 154(b) by 0 days.

(21) Appl. No.: 11/104,053

(22) Filed: Apr. 12, 2005

(65) Prior Publication Data

US 2005/0233652 A1 Oct. 20, 2005

(30) Foreign Application Priority Data

Apr. 14, 2004 (JP) ..... 2004-118649

(51) Int. Cl.
*H01R 13/514* (2006.01)

(52) U.S. Cl. ..... 439/752

(58) Field of Classification Search ..... 439/752, 439/595, 489, 157
See application file for complete search history.

(56) References Cited

U.S. PATENT DOCUMENTS 6,004,158 A 12/1999 Ward
6,171,146 B1 * 1/2001 Fink et al. ..... 439/595
6,200,164 B1 * 3/2001 Martin et al. ..... 439/595
6,358,102 B1 * 3/2002 Fukamachi ..... 439/752
6,364,718 B1 4/2002 Polgar et al.
6,383,020 B1 * 5/2002 Taguchi et al. ..... 439/587
6,527,583 B1 * 3/2003 Plate ..... 439/489
6,655,998 B1 12/2003 Kurimoto
2004/0253883 A1 12/2004 Matsuoka

FOREIGN PATENT DOCUMENTS

JP 2000-182709 6/2000

* cited by examiner

*Primary Examiner*—Alexander Gilman
(74) *Attorney, Agent, or Firm*—Gerald E. Hespos; Anthony J. Casella

(57) ABSTRACT

Two kinds of female terminal fittings (13*a*, 13*b*) are accommodated in a housing (10) and have connecting portions (22*a*, 22*b*) of different lengths. These terminal fittings (13*a*, 13*b*) are inserted into cavities (26*a*, 26*b*) of the housing (10) so that front ends of the terminal fittings (13*a*, 13*b*) are displaced along forward and backward directions so that rear ends of the connecting portions (22*a*, 22*b*) align along an inserting direction of a retainer (33). Thus, the retainer (33) can lock the respective terminal fittings (13*a*, 13*b*) substantially simultaneously.

10 Claims, 16 Drawing Sheets

CONNECTOR AND A CONNECTOR ASSEMBLY

BACKGROUND OF THE INVENTION

1. Field of the Invention

The invention relates to a connector and to a connector assembly.

2. Description of the Related Art

A connector includes a housing and terminal fittings that are mounted in the housing. Each terminal fitting has a connecting portion configured for connection with a mating terminal fitting. Female terminal fittings in such a connector have tubular connecting portions for the connection with male terminal fittings. The front ends of the connecting portions of the terminal fittings are aligned as a prerequisite. A retainer normally is mounted in the housing and engages the rear ends of the connecting portions of the respective terminal fittings to retain the terminal fittings in the housing.

Japanese Unexamined Patent Publication No. 2000-182709 discloses a connector with large and small terminal fittings provided in a mixed manner in conformity with permissible current values. However, the tubular connecting portions have different volumes and different lengths along forward and backward directions depending upon the size of the terminal fittings. Thus, the rear ends of the connecting portions are not aligned with respect to forward and backward directions, and may interfere with a side-mounted retainer. The large and small terminal fittings can be arranged in the housing to avoid the interference with the retainer. Specifically, the shorter terminal fittings can be arranged at an entrance side with respect to an inserting direction of the retainer, and longer terminal fittings can be arranged at a back side with respect to the inserting direction of the retainer. However, connectors with terminal fittings of different lengths along forward and backward directions are deprived of a degree of freedom in designing the arrangement of the terminal fittings.

The present invention was developed in view of the above problem and an object thereof is to provide a connector in which terminal fittings whose connecting portions have different lengths along forward and backward directions are arranged in a mixed manner and with a higher degree of freedom in the arrangement of terminal fittings in a connector housing.

SUMMARY OF THE INVENTION

The invention relates to a connector with a housing having cavities arranged along a width direction. The connector has a plurality of different kinds of terminal fittings that are insertable into the cavities. Each terminal fitting has a connecting portion that is connectable with a mating terminal fitting. The connecting portions of the different kinds of terminal fittings have different lengths along forward and backward directions. A retainer is mountable into the housing along an arranging direction of the cavities for simultaneously engaging locks on the connecting portions of the respective terminal fittings that have been mounted properly in the housing and for retaining the respective terminal fittings in the cavities. The locks of the properly mounted terminal fittings substantially align along an insertion direction of the retainer into the housing. Thus, the retainer can engage the locks regardless of the arrangement of the terminal fittings even though the connecting portions have different lengths. Accordingly, a degree of freedom in arranging the terminal fittings is improved.

Projected positions of the terminal fittings from the front end surface of the housing preferably differ depending on the lengths of the connecting portions along forward and backward directions. The locks are defined by the rear ends of the connecting portions and substantially align with respect to an inserting direction of the terminal fittings. Thus, the construction is simpler than a case where the locks are at intermediate positions of the connecting portions.

The retainer preferably can be positioned at a first position, where the insertion and withdrawal of the terminal fittings to and from the respective cavities is permitted, and a second position, where the terminal fittings are locked in the respective cavities.

A front holder preferably is mountable on the housing to define abutments for at least part of the cavities against which the properly inserted terminal fittings can abut.

An area of a front surface of the front holder corresponding to the cavities projecting from the front surface of the front holder is displaced along forward and backward directions.

The retainer preferably comprises a plurality of locking portions for locking the respective terminal fittings in the respective cavities.

The locking portions have a substantially cranked shape. A free length of the locking portions at one side is shorter than that of the locking portions at the other side along an inserting direction of the retainer. Additionally, the locking portions at one side are thicker than the locking portions at other side.

The invention also is directed to a connector assembly comprising the above-described connector and a mating connector. The terminal fittings are retained in the housing with front ends of the terminal fittings of one kind located slightly behind the front ends of the terminal fittings of the other kind. The displacement of the terminal fittings corresponds to a displacement between the leading ends of mating terminal fittings of the mating connector.

One of the connector and the mating connector may comprise a forcible connection preventing wall that projects from a main body thereof. The forcible connection-preventing wall interferes with the other of the connector and the mating connector in response to an attempt to connect the connector and the mating connector in an improper posture. The forcible connection-preventing wall preferably is on the mating connector and the retainer is formed with an insertion hole to accommodate the forcible connection preventing wall when the retainer locks the terminal fittings.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
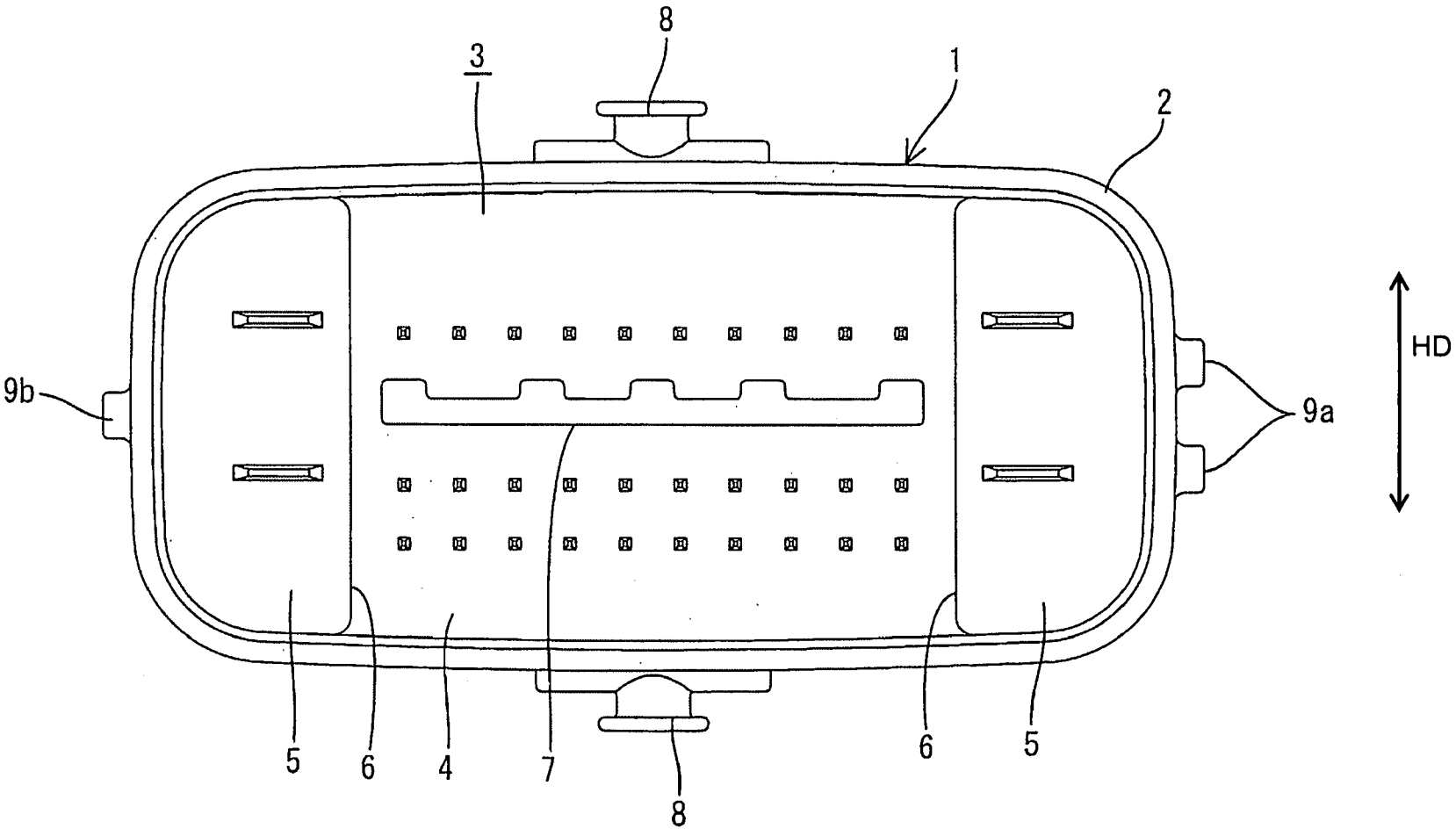
FIG. 1 is a front view of a male connector housing.

A hybrid male connector according to the invention has a housing 1 that preferably is made of a synthetic resin. In the following description, a mating side of the connector with a mating connector is referred to as the front. The housing 1 has a forwardly open tubular receptacle 2 that projects forward from a main body 3, as shown in FIG. 1. The main body 3 accommodates large and small terminal fittings (not shown) in a mixed manner. The large male terminal fittings are accommodated at upper and lower stages at the left and right sides and the smaller male terminal fittings are accommodated at three stages between the larger male terminal fittings in FIG. 1. Tabs of the male terminal fittings project from the front wall of the main body 3 and into the receptacle 2 for protection by the receptacle 2. The front wall of the main body 3 has a middle area 4 where the small terminal fittings are accommodated and left and right areas 5 at opposite left and right sides of the middle area 4 for accommodating the large terminal fittings. Although not shown in detail, steps or slanted surfaces 6 are set between the middle area 4 and the left and right areas 5 so that the middle area 4 projects more forward than the left and right areas 5. Accordingly, the front end positions of tabs t1 of the smaller terminal fittings projecting from the middle area 4 are more forward than the front ends of tabs t2 of the larger terminal fittings projecting from the left and right areas 5.

A forcible connection preventing wall 7 projects from the front wall of the main body 3 in an intermediate part of the middle area 4 with respect to a height direction HD. The front end of the forcible connection-preventing wall 7 is substantially aligned with the front end of the receptacle 2. The forcible connection-preventing wall 7 will interfere with a female housing 10 that is in an improper posture during a connection attempt, thereby avoiding deformation of the tabs. Further, as shown in FIG. 1, upside-down insertion preventing ribs 9*a*. 9*b* are arranged on the outer surfaces of the shorter sides of the receptacle 2. The ribs 9*a*, 9*b* are arranged in a rotationally asymmetric way to allow connection only in one rotational orientation. In FIG. 1, one rib 9*b* is arranged substantially along a connecting direction CD in the middle with respect to the height direction HD at one side, whereas two ribs 9*a* are arranged substantially along the height direction HD at the other side. Therefore, upside-down insertion of the female housing 10 into the male housing 1 can be avoided.

Cam pins 8 project in a substantially in the widthwise middle on the outer surface of each longer side of the receptacle 2. As described later, the cam pins 8 assist the connection of the female and male connectors.

Figure 2:
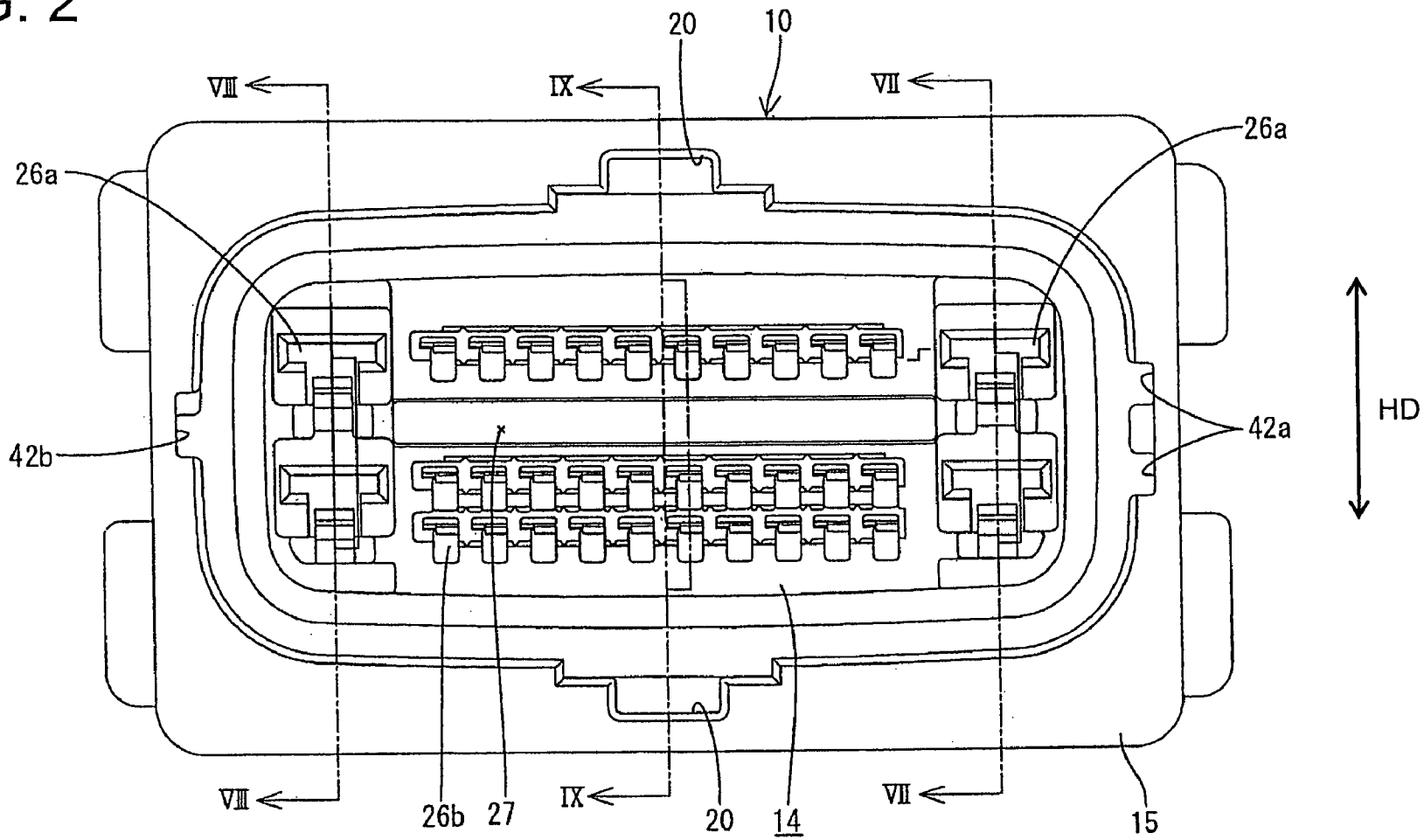
FIG. 2 is a front view of a female connector housing.
Figure 3:
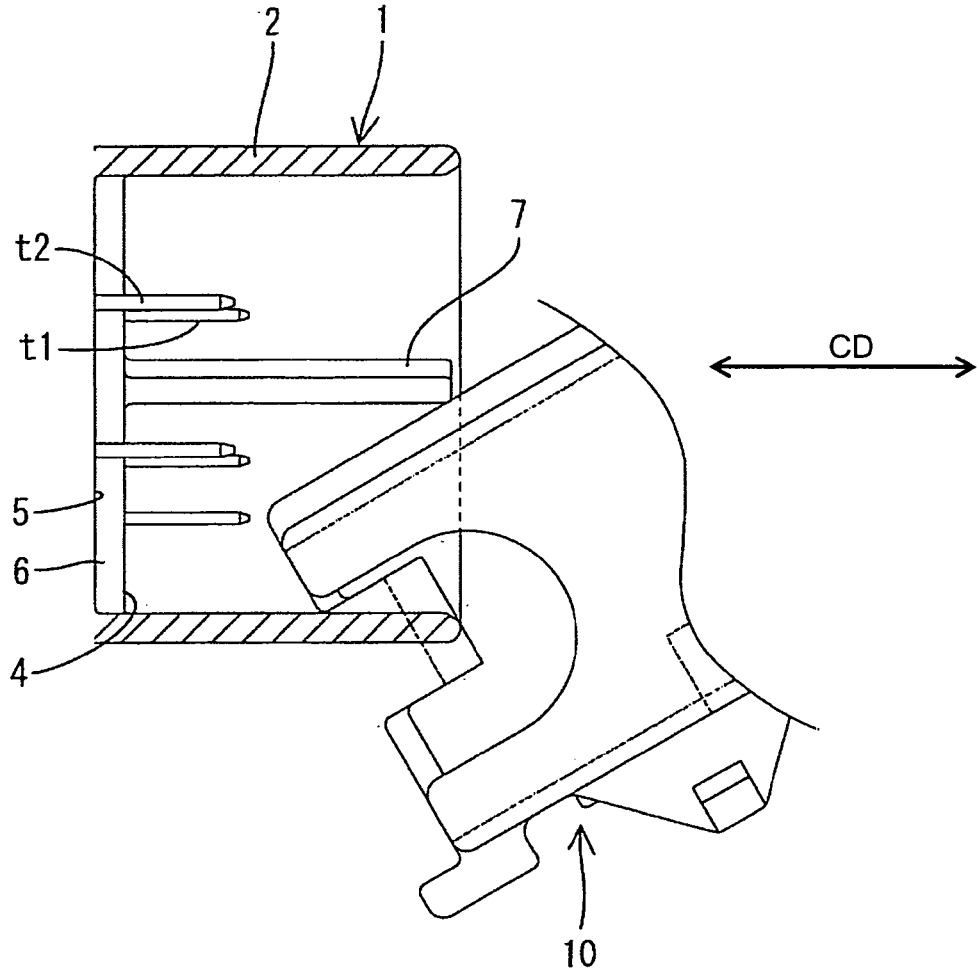
FIG. 3 is a section showing an essential portion of a forcibly connecting state of the male and female connector housings.
Figure 16:
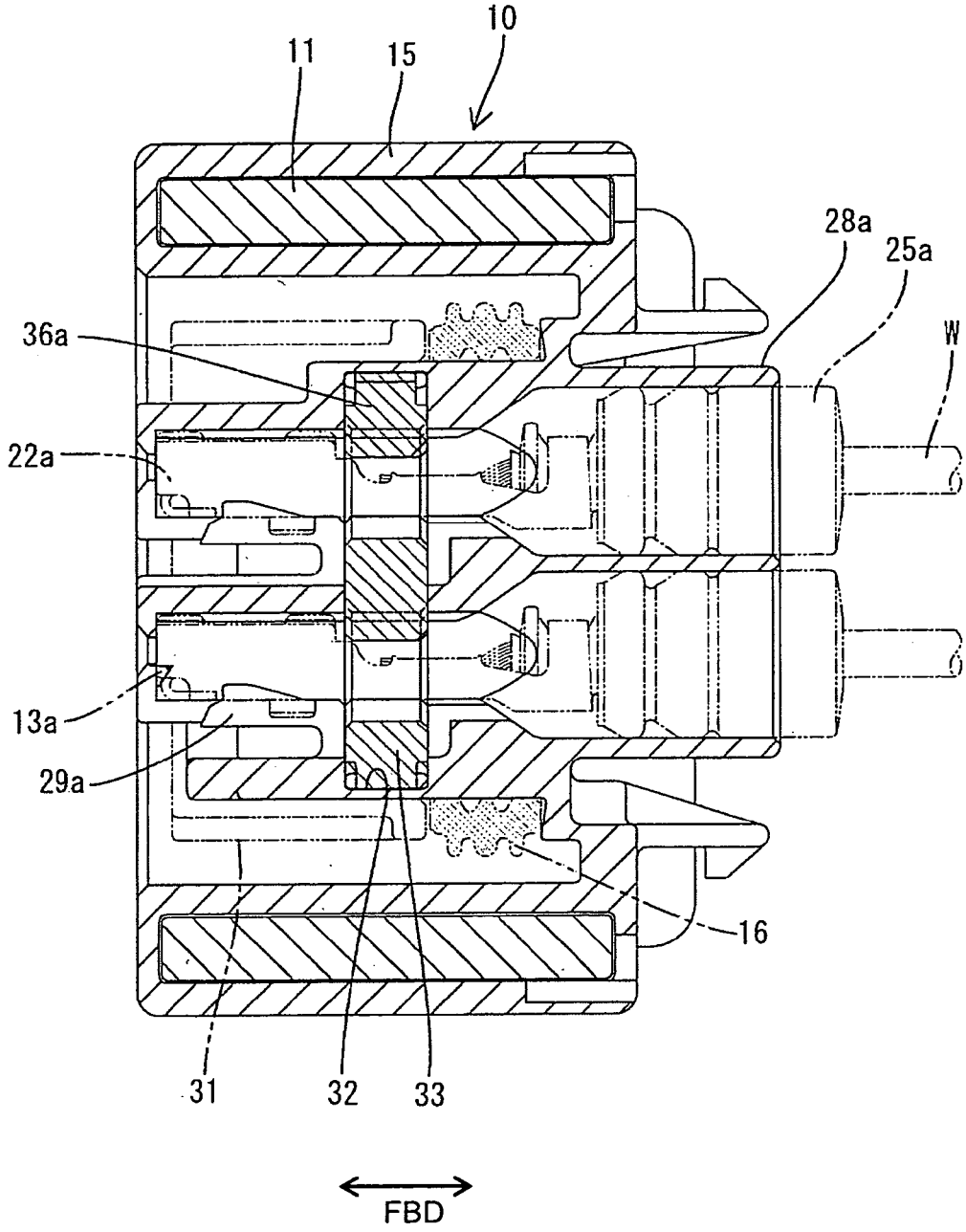
FIG. 16 is a section, corresponding to FIG. 7, showing a state where the retainer and a front holder are mounted.
Figure 17:
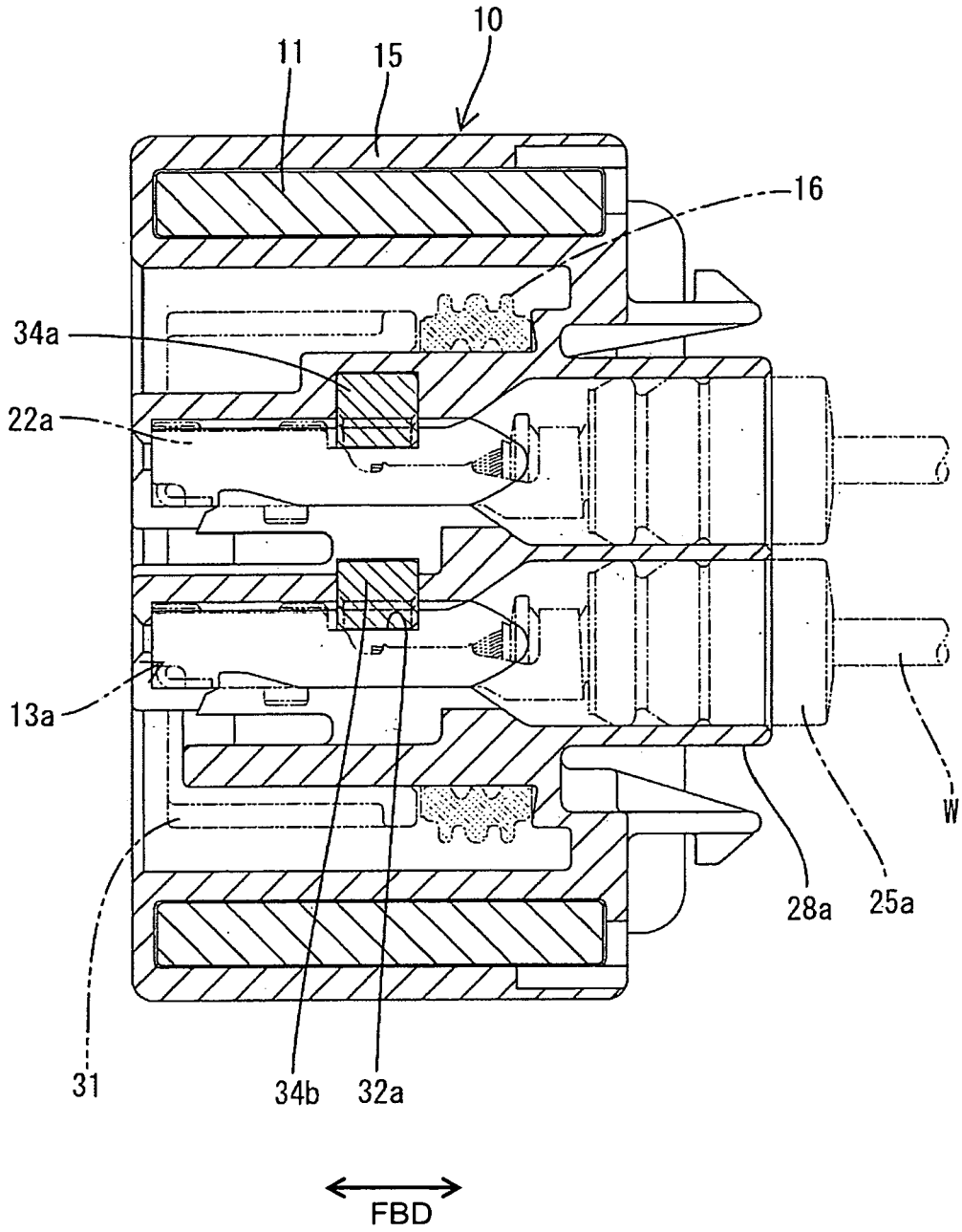
FIG. 17 is a section corresponding to FIG. 8.
Figure 18:
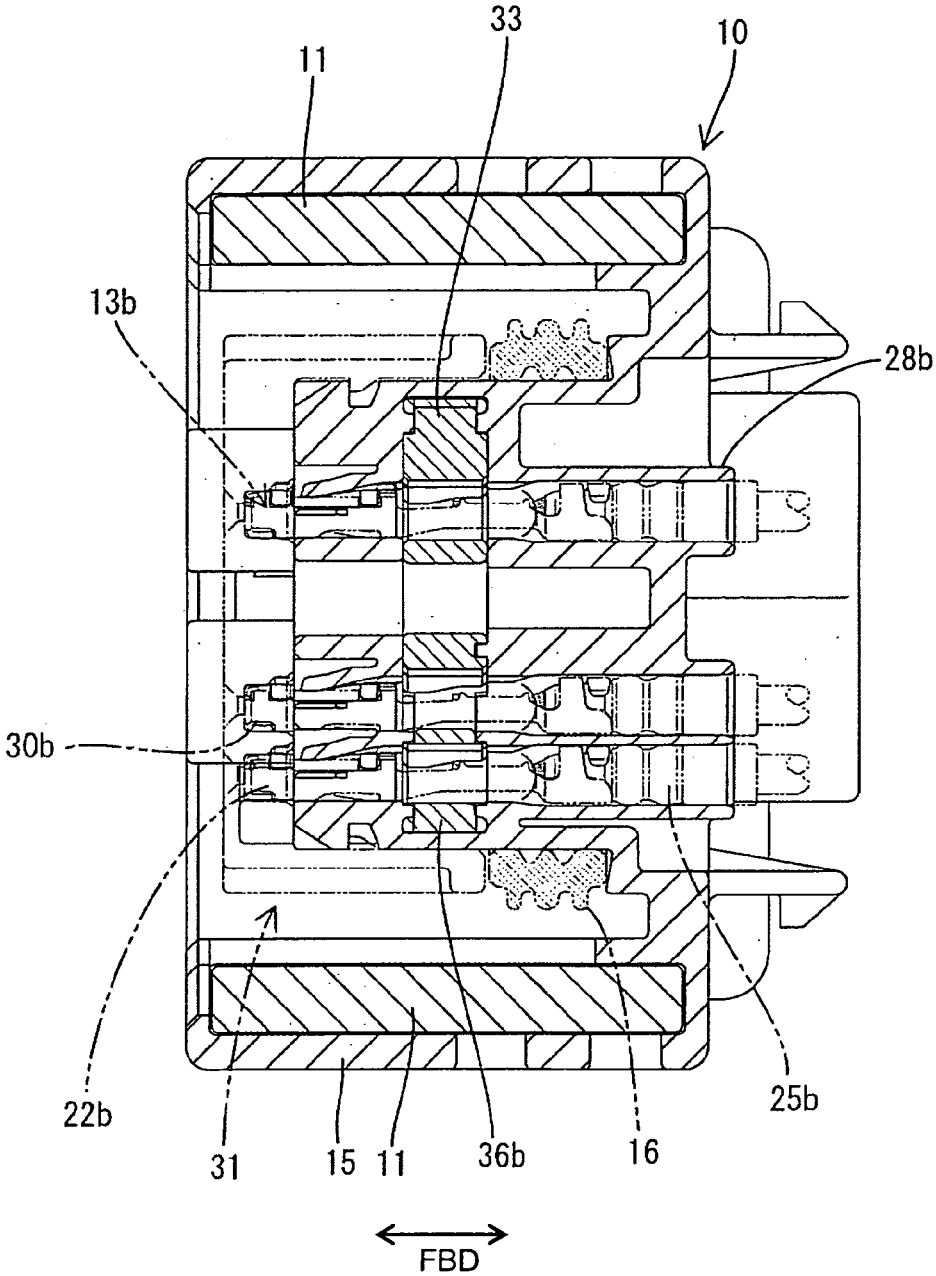
FIG. 18 is a section corresponding to FIG. 9.

The female housing 10, as shown in FIG. 2, is made unitarily e.g. of a synthetic resin. The female housing 10 has female terminal fittings 13*a*, 13*b* accommodated in a terminal-accommodating portion 14. An outer tube 15 substantially surrounds the terminal-accommodating portion 14 so that a connection space for the male housing 1 is between the terminal-accommodating portion 14 and the outer tube 15. As shown in FIG. 16, a resilient seal ring 16 is mounted at a back end of the outer surface of the terminal-accommodating portion 14. The seal ring 16 closely contacts the inner surface of the receptacle 2 over substantially the entire periphery to provide sealing between the female and male housings 10, 1.

Figure 4:
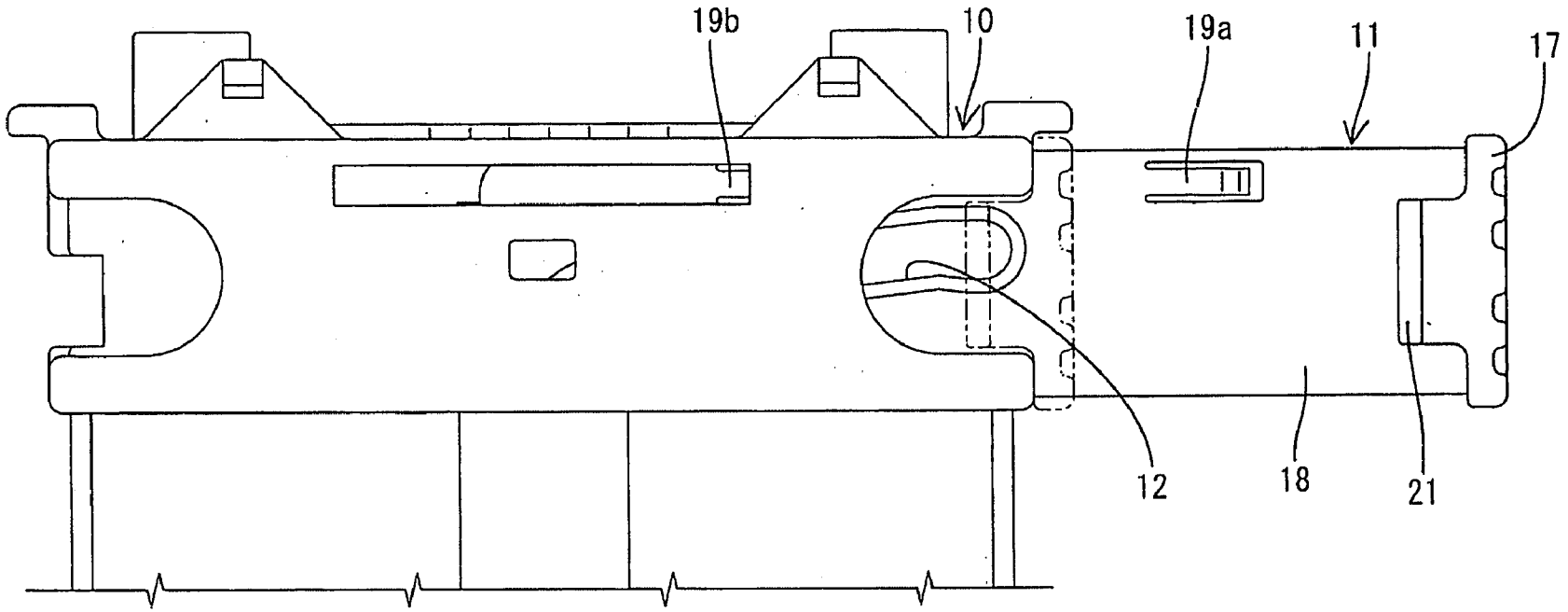
FIG. 4 is a side view showing a connecting operation of the male and female connector housings.

The outer tube 15 has a substantially hollow structure, and a slide lever 11 is accommodated inside for assisting the connecting operation of the male and female connector housings 1, 10. The opposite shorter sides of the outer tube 15 are entirely open, and the slide lever 11 is insertable laterally in an inserting direction at an angle and substantially normal to the connecting direction CD (from right side of FIG. 4). The slide lever 11 has an operable portion 17 to operate (e.g. insert and withdraw) the slide lever 11 and two opposed lever pieces 18 extend from the opposite ends of the operable portion 17. Thus, the slide lever 11 is substantially U-shaped.

Two resiliently deformable locking claws 19*a*, 19*b* are formed at one longer side of each lever piece 18 and are spaced apart along the longitudinal direction of the lever pieces 18. The respective locking claws 19*a*, 19*b* are cantilevered with their free ends at a front side with respect to a withdrawing direction of the slide lever 11. The locking claws 19*a*, 19*b* are engageable with unillustrated engaging portions formed on the inner wall surfaces of the outer tube 15 to holding the slide lever 11 at an initial position and a connection ending position.

Each lever piece 18 has a cam groove 12 with an entrance at the longer edge of the lever piece 18. The entrances of the cam grooves 12 align with cam-pin receiving openings 20 (see FIG. 2) in the widthwise middle of the front surface of the outer tube 15 when the slide lever 11 is at the initial position. Thus, the cam pins 8 can be introduced into the entrances of the cam grooves 12 via the cam-pin receiving openings 20 to fit the male and female housings 1, 10 lightly together. The slide lever 11 is pushed into the outer tube 15 from the initial position to guide the cam pins 8 towards the back ends of the cam grooves 12 by the cam function of the cam pins 8 with the cam grooves 12. The male and female housings 1, 10 are connected properly when the slide lever 11 is pushed to the connection ending position.

Bulges 21 are formed on both lever pieces 18 near the operable portion 17 and are used for the withdrawing operation. Upside-down insertion preventing rails 42*a*, 42*b* receive the upside-down preventing ribs 9*a*, 9*b* when the male and female housings 1, 10 are connected in proper postures to guide the connecting operation of the male and female housings 1, 10. The rails 42*a*, 42*b* interfere with the ribs 9*a*, 9*b* if an attempt is made to insert the female housing 10 in a wrong posture, thereby making the connecting operation impossible and notifying an operator of an erroneous connection.

Figure 5:
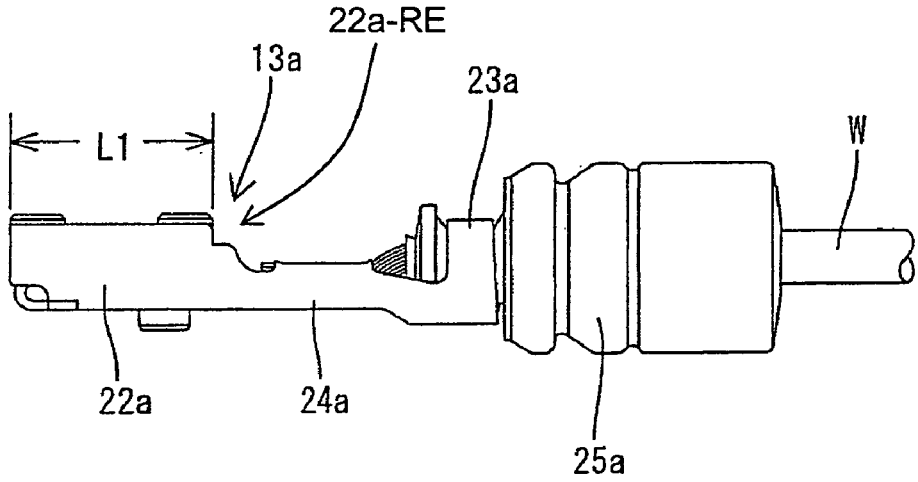
FIG. 5 is a side view showing a terminal fitting for power.
Figure 6:
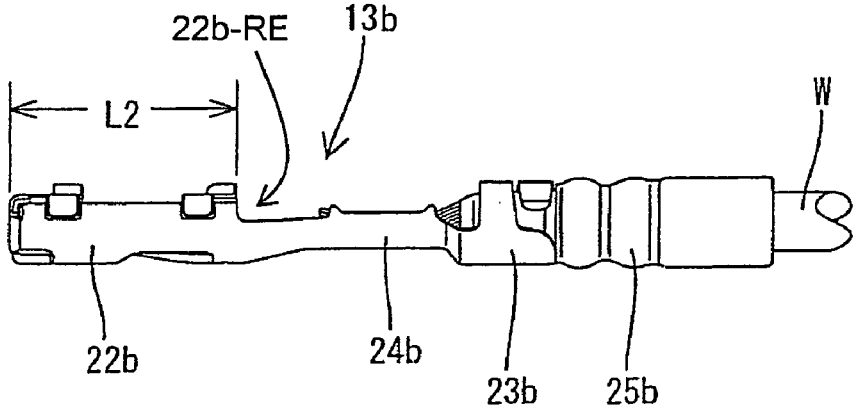
FIG. 6 is a side view showing a terminal fitting for signal.

Large and small female terminal fittings 13*a*, 13*b* are accommodated in the terminal accommodating portion 14 in conformity with permissible current values (see FIGS. 5 and 6). The female terminal fittings 13*a*, 13*b* are formed by bending plates made of an electrically conductive material (preferably metal), and include connecting portions 22*a*, 22*b* for connection with the male tabs t1, t2. The connecting portions 22*a*, 22*b* are substantially rectangular tubes with parts that can be brought resiliently into contact with the male tabs t1, t2. Wire barrels 24*a*, 24*b* to be crimped, bent or folded into connection with cores of the wires are provided behind the connecting portions 22*a*, 22*b*, and insulation barrels 23*a*, 23*b* are arranged behind the wire barrels 24*a*, 24*b*. In this embodiment, sealing rubber plugs 25*a*, 25*b* are mounted at ends of insulation coatings of the wires, and the wire barrels 24*a*, 24*b* are crimped, bent or folded into connection with the insulation coatings of the wires together with the sealing rubber plugs 25*a*, 25*b*.

Lengths of the connecting portions 22*a*, 22*b* along forward and backward directions FBD differ (L1>L2 shown in FIGS. 5 and 6) to define terminal fittings 13*a* for power and terminal fittings 13*b* e.g. for signal.

Cavities 26*a*, 26*b* for the female terminal fittings 13*a*, 13*b* are arranged at stages in the terminal accommodating portion 14 of the female connector housing 10. As shown in FIG. 2, two kinds of cavities 26*a*, 26*b* are arranged in a mixed manner at the respective stages and correspond to the differently dimensioned female terminal fittings 13*a*, 13*b*. The cavities at each stage are arranged along the width direction with the heights thereof substantially aligned. Two larger cavities 26*a* are arranged one substantially above the other at each of the left and right sides in FIG. 2 for accommodating the larger terminal fittings 13*a* for power. The larger cavities 26*a* are aligned along the height direction HD. The smaller cavities 26*b* accommodate smaller the terminal fittings 13*b* for signal and are arranged at upper and lower sides of an accommodating recess 27 for accommodating the forcible connection preventing wall 7 of the male connector housing 1. The smaller cavities 26*b* above the accommodating recess 27 substantially align in a row along widthwise direction at substantially even intervals, whereas those below the accommodating recess 27 are arranged substantially along widthwise directions at substantially even intervals at upper and lower stages. The phases of the smaller cavities 26 at each stage are substantially aligned with respect to the height direction.

Figure 7:
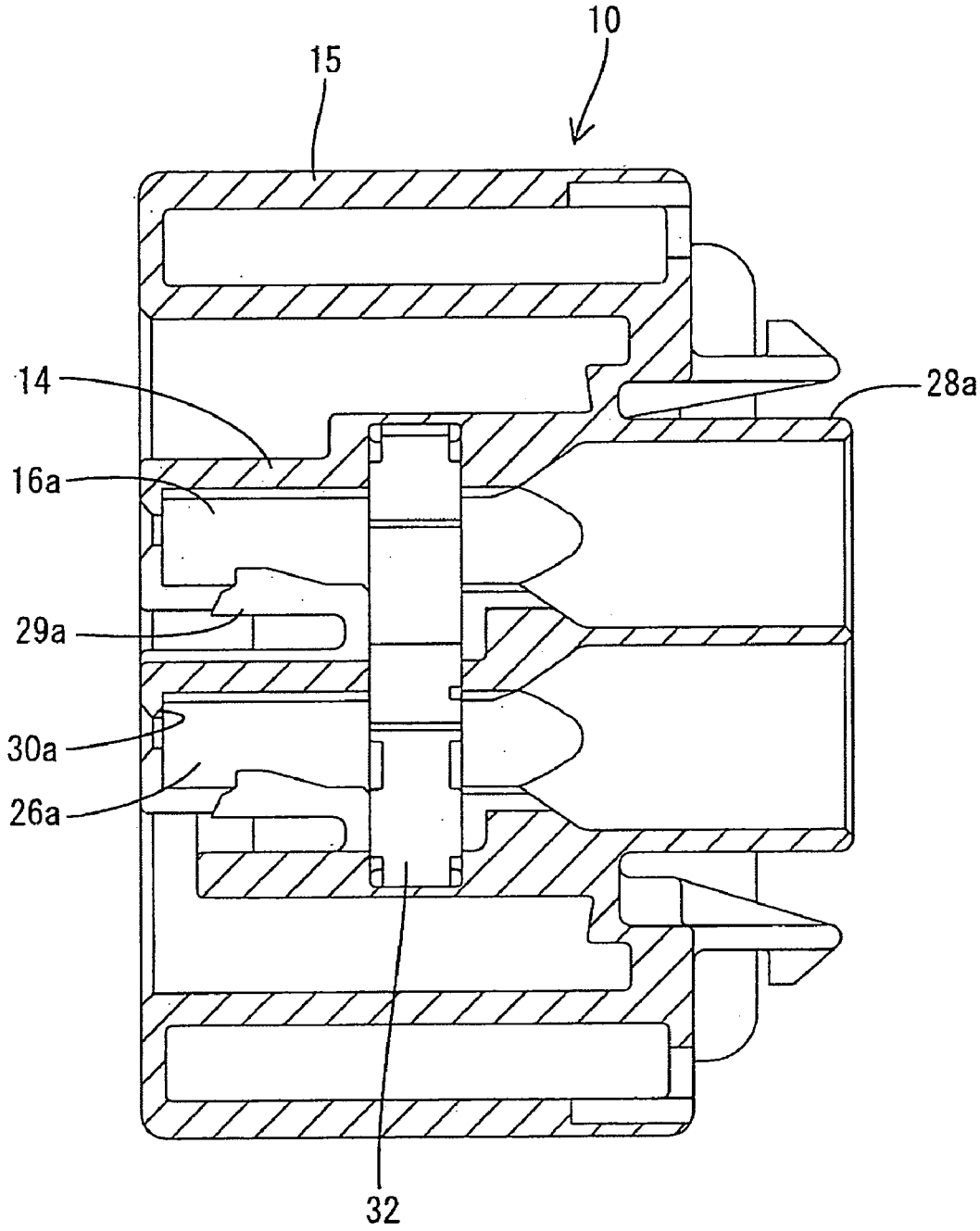
FIG. 7 is a section along VII—VII of FIG. 2.
Figure 8:
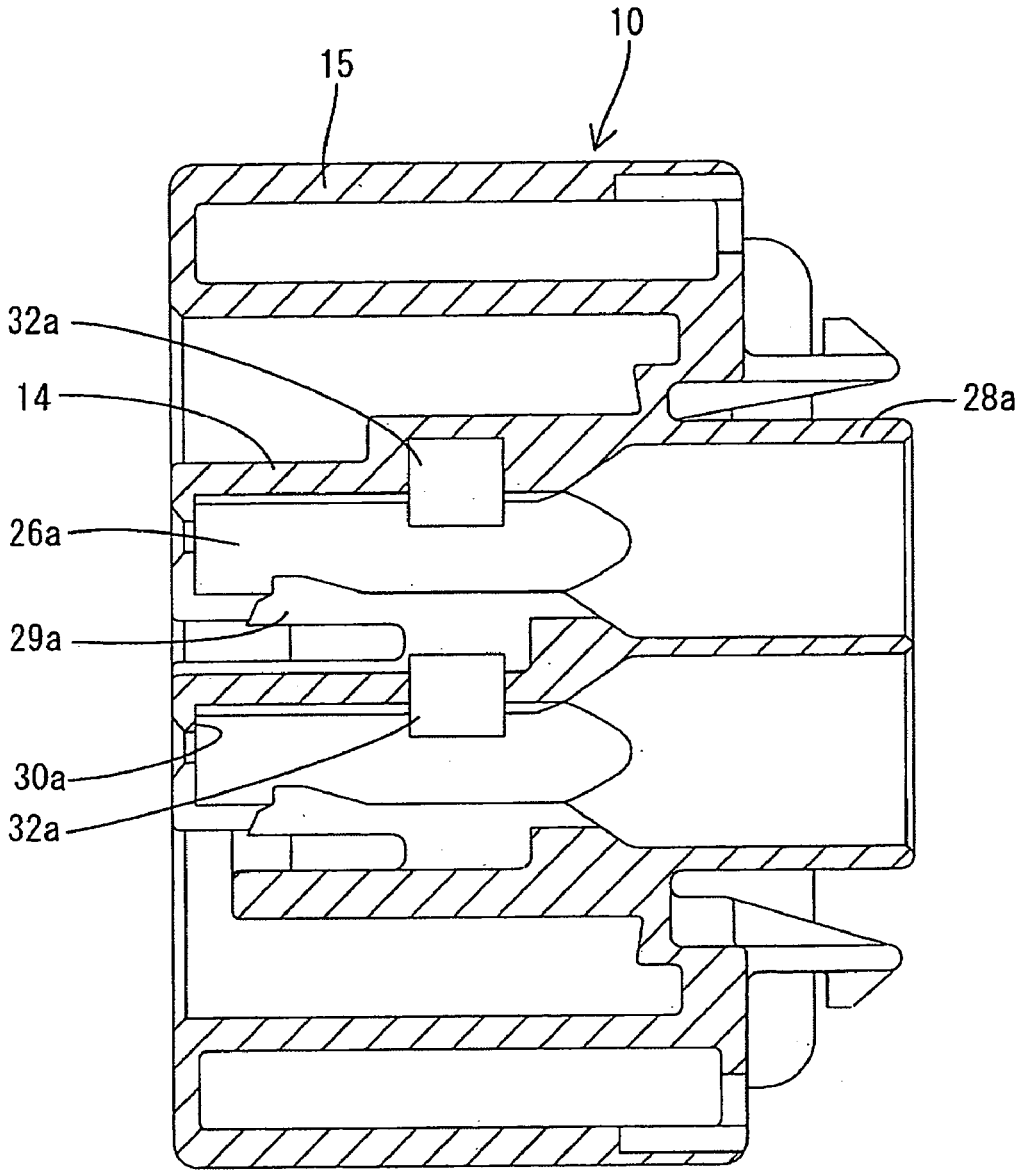
FIG. 8 is a section along VIII—VIII of FIG. 2.
Figure 9:
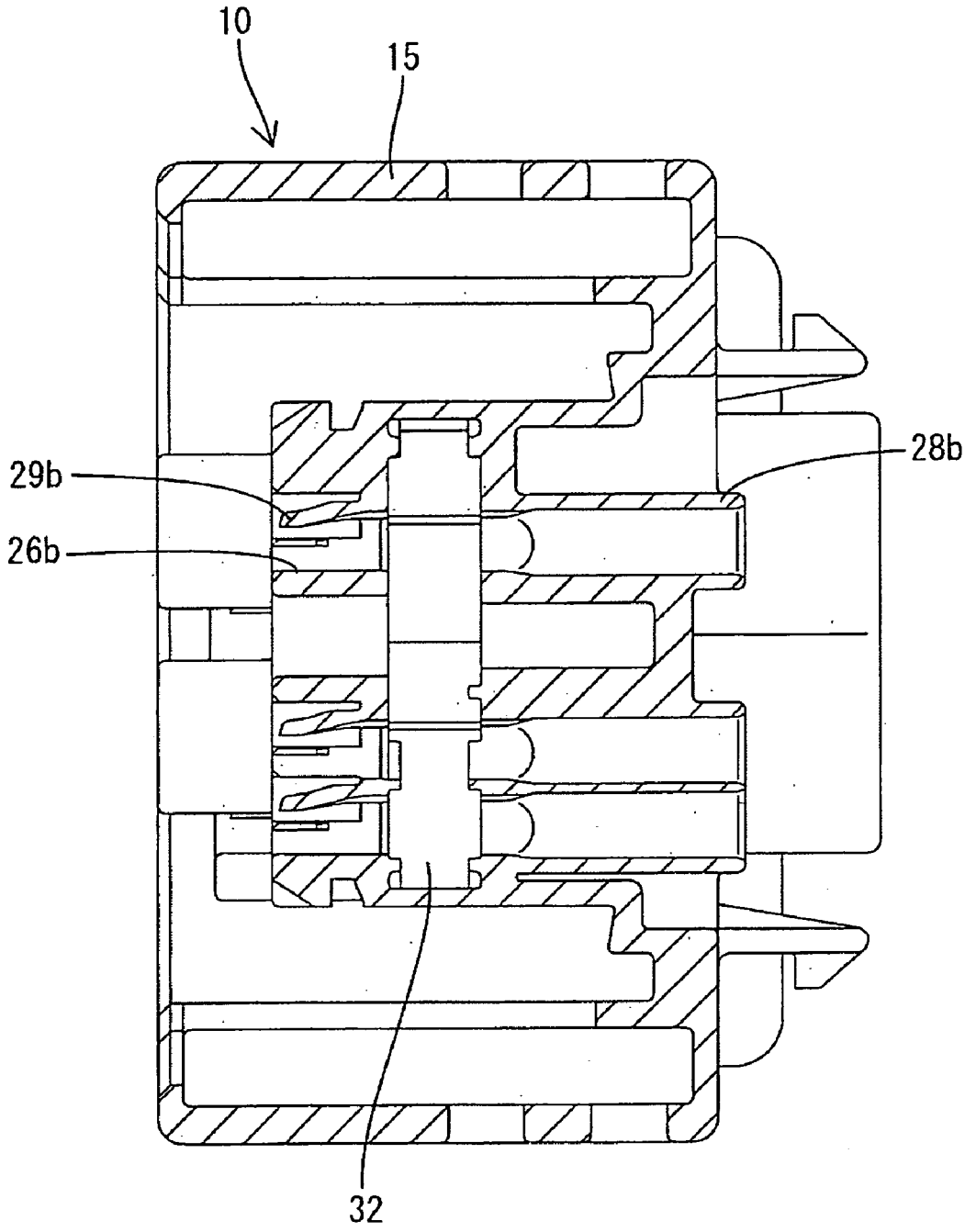
FIG. 9 is a section along IX—IX of FIG. 2.
Figure 10:
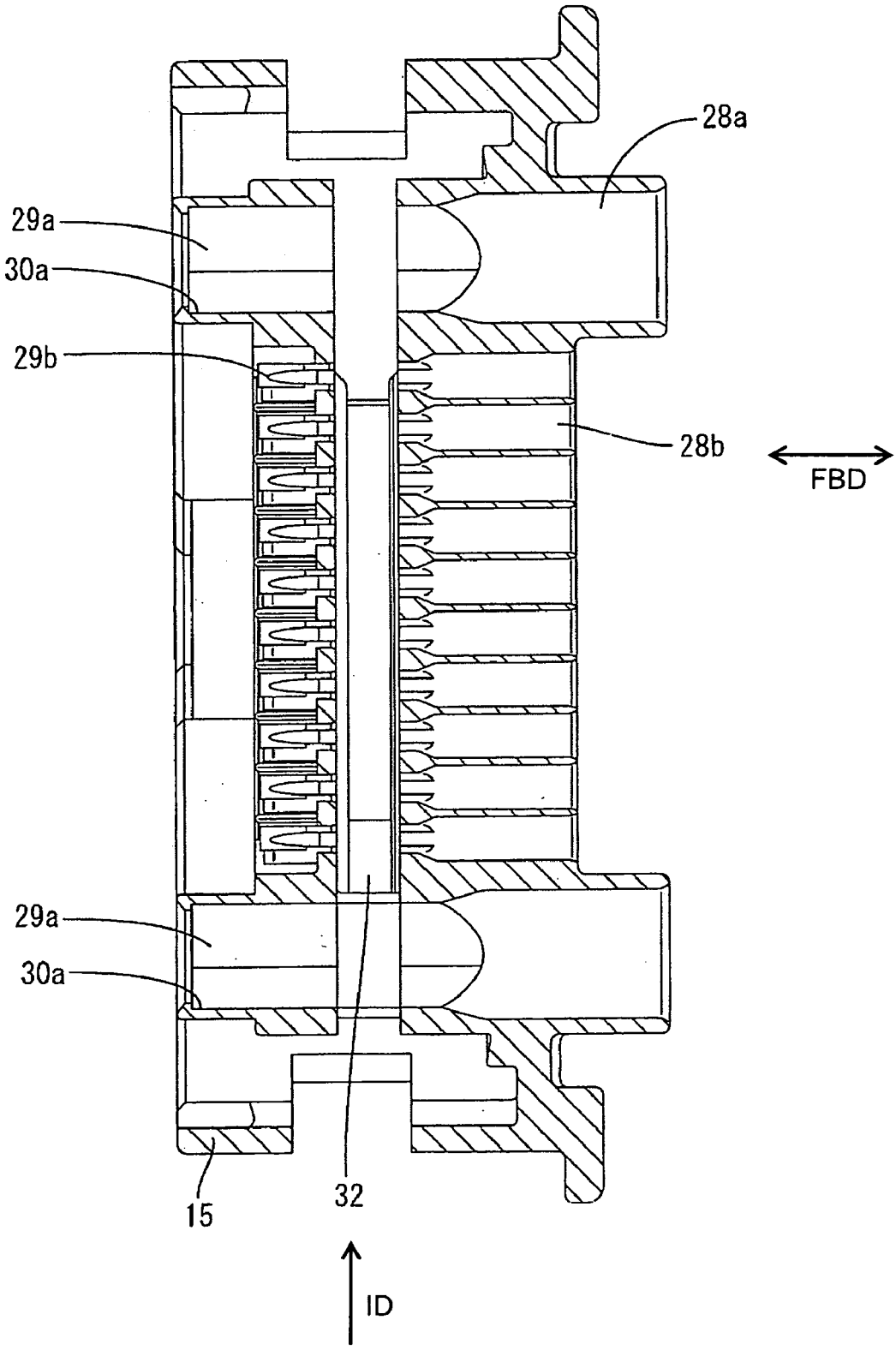
FIG. 10 is a section along X—X of FIG. 2.
Figure 11:
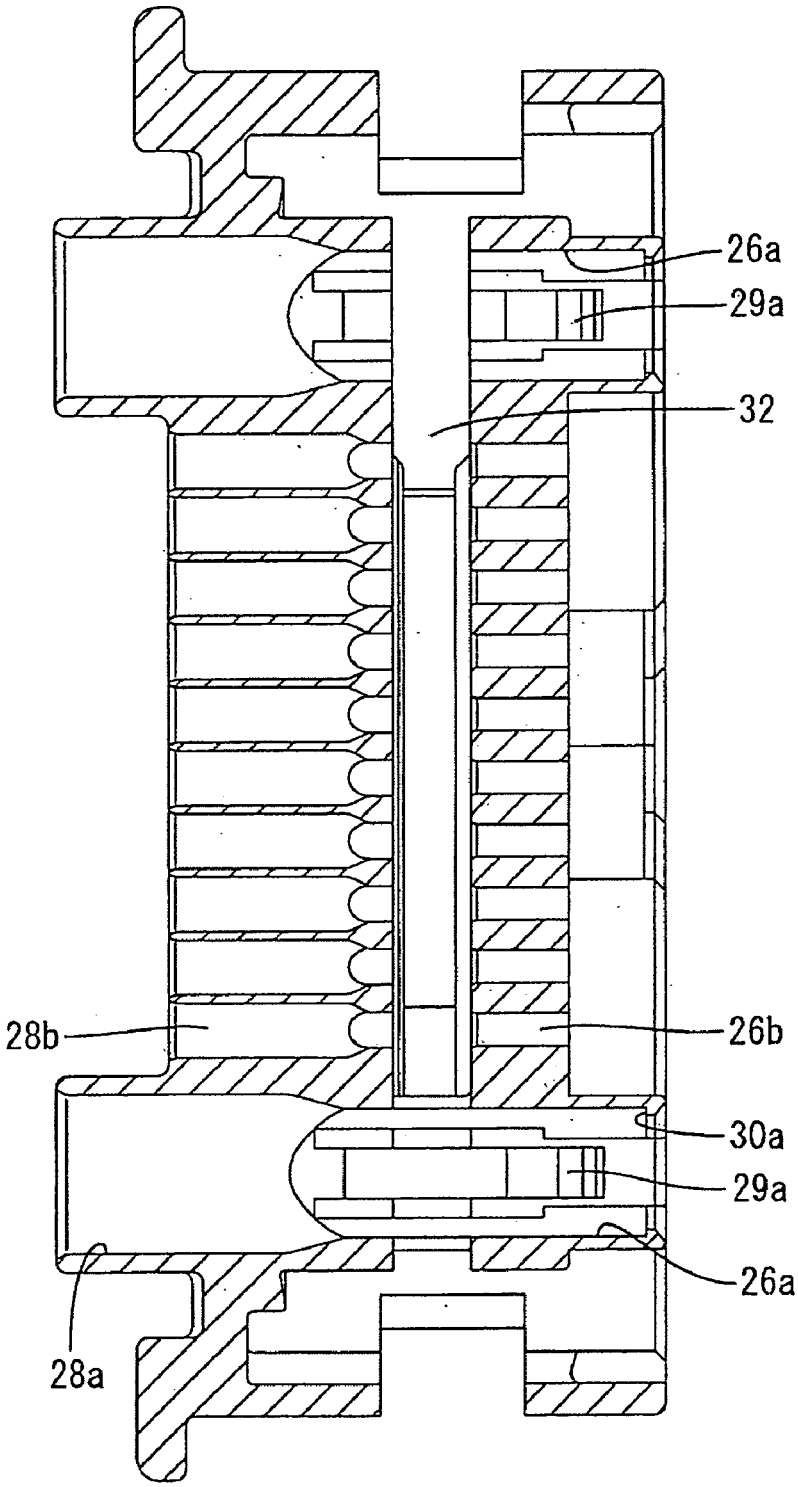
FIG. 11 is a section along XI—XI of FIG. 2.
Figure 12:
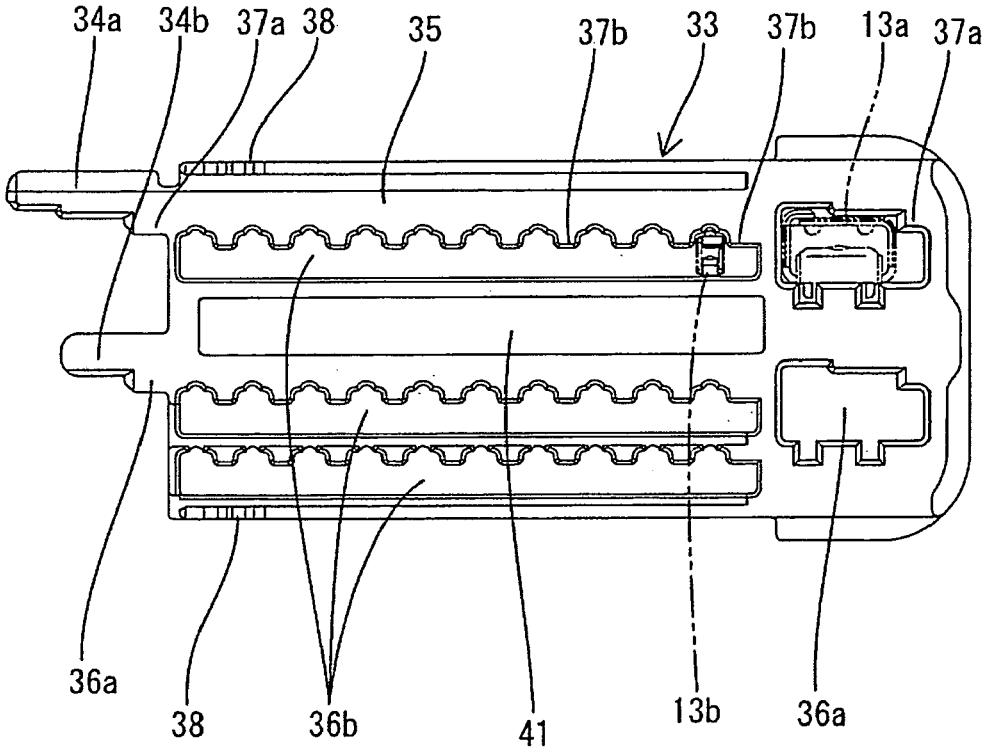
FIG. 12 is a front view of a retainer showing a relationship with terminal fittings when the retainer is at a partial locking position.

The larger and smaller cavities 26*a*, 26*b* penetrate the female connector housing 10 along forward and backward directions FBD (see FIG. 7). A hollow cylindrical sealable tower 28*a*, 28*b* is formed at a rear side of each cavity 26*a*, 26*b*. Sealability is ensured by inserting the sealing rubber plugs 25*a*, 25*b* into the sealable towers 28*a*, 28*b*. On the other hand, a resilient lock 29*a*, 29*b* is formed at a wall surface of the front side of each cavity 26*a*, 26*b* for engaging an intermediate position of the connecting portion 22*a*, 22*b* of the corresponding female terminal fitting 13*a*, 13*b*. Each lock 29*a*, 29*b* cantilevers forwardly, and can deform vertically towards and away from the respective cavity 26*a*, 26*b*. The locks 29*a* corresponding to the terminal fittings 13*a* for power are formed at the bottom surfaces of the cavities 26*a*, as shown in FIG. 7 or 8. However, the locks 29*b* corresponding to the terminal fittings 13*b* for signal are formed at the opposite ceiling surfaces, as shown in FIG. 9. Each larger cavity 26*a* has a front wall 30*a* for contacting the front of the terminal fitting 13*a* for power. However, each smaller cavity 26*b* has no front wall.

As is clear from FIGS. 7 to 9, areas of the front end surface of the terminal accommodating portion 14 corresponding to the larger cavities 26*a* are substantially flush with the front end of the outer tube 15, but an area corresponding to the smaller cavities 26*b* is retracted back from the front end edge of the outer tube 15. The rear ends of the connecting portions 22*a*, 22*b* of the respective terminal fittings 13*a*, 13*b* substantially align along width direction when the terminal fittings 13*a*,13*b* are accommodated to proper depths in the corresponding cavities 26*a*, 26*b*.

A retainer insertion hole 32 is formed in a side surface the terminal accommodating portion 14 substantially opposite from the surface where the slide lever 11 is inserted and before the seal ring 16. The retainer insertion hole 32 extends substantially along the width direction of the terminal-accommodating portion 14 and substantially normal to the inserting direction of the respective terminal fittings. Thus, the retainer 33 is insertable into the retainer insertion hole 32 in an insertion direction ID substantially normal to the forward and backward direction FBD. Upper and lower openings 32*a* are formed in the opposite side surface of the terminal accommodating portion 14 (see FIG. 8). Thus, most of the cavities 26*a*, 26*b* are divided into front and rear sections by the retainer insertion hole 32, including parts of the locks 29*a*, 29*b* behind the base ends of the locks 29*a*, 29*b* (see FIGS. 7 and 8). The locks 29*a* of the larger cavities 26*a* are not divided by the retainer insertion hole 32 in only the upper and lower cavities 26*a* located at the back with respect to an inserting direction of the retainer 33, as shown in FIG. 9. The strength of the terminal-accommodating portion 14 would be reduced if a large opening was formed instead of the upper and lower openings 32*a*. However, with such openings 32*a*, deformability differs between the locks 29*a* in the larger cavities 26*a* at the left side in FIG. 2 and those in the larger cavities 26*a* at the right side. As a result, inserting forces exerted on the female terminal fittings 13*a* are unbalanced between the left and right larger cavities 26*a*. Accordingly, the free length from the base end of the lock to the locking surface in FIG. 7 for the locks 29*a* in the larger cavities 26*a* at the left side is shorter than the length of the locks in the larger cavities 26*a* at the right side and the former locks 29*a* are made thicker than the latter locks 29*a*. In this way, the locks 29*a* in the left and right larger cavities 26*a* have substantially equal deformability.

Figure 13:
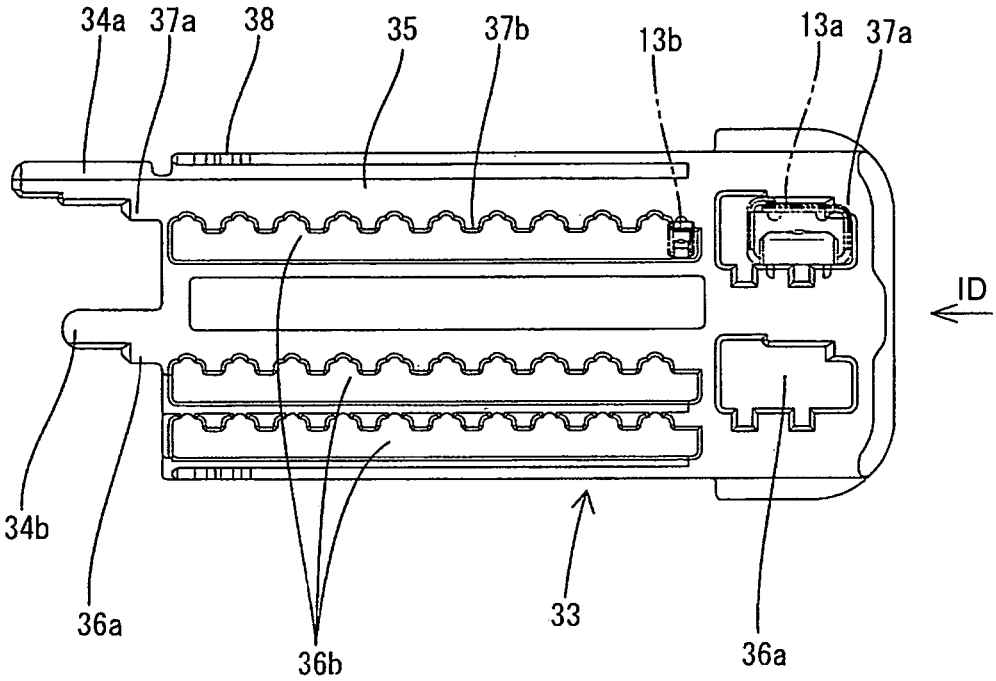
FIG. 13 is a front view of the retainer showing a relationship with the terminal fittings when the retainer is at a full locking position.

As shown in FIG. 13, the retainer 33 has a frame-shaped portion 35 and two locking legs 34*a*, 34*b* of different lengths project along the width direction from one shorter side of the frame-shaped portion 35. The entire length of the retainer 33 along the width direction substantially equals the width of the terminal-accommodating portion 14. The retainer 33 has signal terminal locking sections 36*b* for locking the respective signal terminal fittings 13*b* and power terminal locking sections 36*a* for locking the power terminal fittings 13*a*. The signal terminal locking sections 36*b* are oblong openings extending along the width direction to communicate with all the cavities 26*b* at the corresponding stages, and are formed at three stages. Each signal terminal locking section 36*b* has smaller locking projections 37*b* formed at intervals substantially corresponding to intervals of the cavities 26*b* at the corresponding stage. The smaller locking projections 37*b* are offset from the signal terminal fittings 13*b* when the retainer 33 is at a partial locking position. However, the smaller locking projections 37*b* are engageable with the rear ends 22*b*-RE of the connecting portions 22*b* of the signal terminal fittings 13*b* when the retainer 33 is moved to a full locking position.

There are two kinds of the power terminal locking sections 36*a*, those formed at an end inside the frame-shaped portion 35 and those formed at the locking legs 34*a*, 34*b*. Those inside the frame-shaped portion 35 are two upper and lower windows formed substantially in conformity with the larger cavities 26*a* at the left side of FIG. 2. A larger locking projection 37*a* projects at one corner of each window. On the other hand, larger locking projections 37*a* are provided at the base ends of both locking legs 34*a*, 34*b* in the power terminal locking sections 36*a* set at the locking legs 34*a*, 34*b*. Thus, the larger and smaller locking projections 37*a*, 37*b* are arranged along the longitudinal direction of the retainer 33 with the positions substantially aligned with respect to forward and backward directions FBD.

Figure 14:
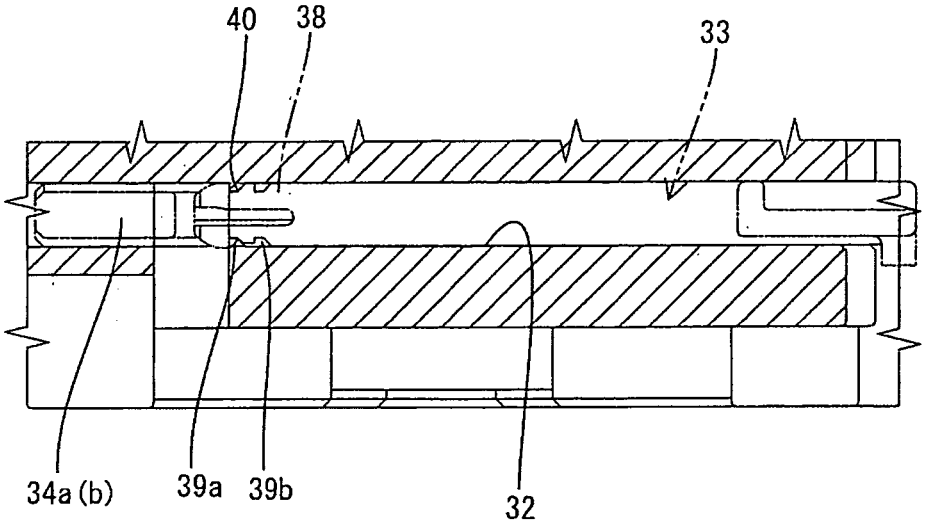
FIG. 14 is a section showing a state where the retainer is at the partial locking position.
Figure 15:
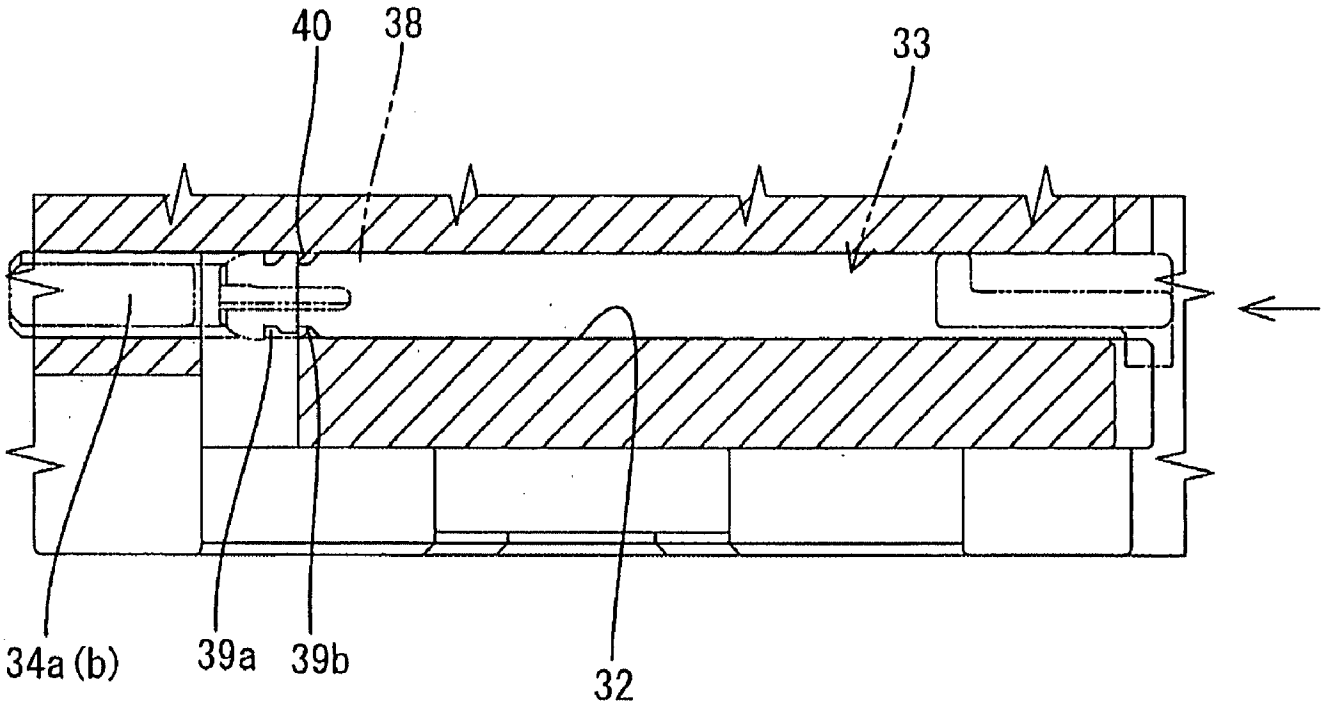
FIG. 15 is a section showing a state where the retainer is at the full locking position.

The retainer 33 is displaceable between the partial locking position where the signal terminal fittings 13*b* and the power terminal fittings 13*a* are insertable and withdrawable and the full locking position where the retainer 33 engages the lockable parts 22*a*-RE, 22*b*-RE of the respective terminal fittings 13*a*, 13*b* to retain them in the cavities 26*a*, 26*b*. Holding portions 38 are provided on longer sides of the frame-shaped portion 35 near the locking legs 34*a*, 34*b* for this displacement. As shown in FIG. 14, the leading ends of the retainer holding portions 38 are permitted to undergo a narrowing deformation. A partial locking recess 39*a* and a full locking recess 39*b* are formed at two positions on the outer surface of the free end of preferably each forked part. Lock projections 40 project inward at the walls of the retainer insertion hole 32 substantially in conformity with the partial and full locking recesses 39*a*, 39*b*. The lock projections 40 engage resiliently with the partial locking recesses 39*a* and the full locking recesses 39*b* to hold the entire retainer 33 at the partial locking position (FIG. 14) and the full locking position (FIG. 15).

The frame-shaped portion 35 of the retainer 33 has an insertion hole 41 that aligns with the accommodating recess 27 to receive the forcible connection-preventing wall 7 when the retainer 33 is at the full locking position.

The front holder 31 is made e.g. of a synthetic resin and is a substantially rectangular tube fittable on the outer peripheral surface of the front end of the terminal-accommodating portion 14. Front-end portions of the smaller cavities 26*b* are formed in an area of the front surface of the front holder 31 to enable the signal terminal fittings 13*b* to stop at their front end positions. These front-end portions permit the insertion of the tabs of the male terminal fittings. However, openings are formed in areas of the front surface of the front holder 31 corresponding to the larger cavities 26*a*, and the front ends of the larger cavities 26*a* project forward through these openings. The peripheral edge of the front holder 31 at the rear end contacts the front edge of the seal ring 16 to prevent the seal ring 16 from coming out.

Even in a state where the front holder 31 is mounted, the area of the front surface of the front holder 31 substantially corresponding to the smaller cavities 26*b* and the areas thereof corresponding to the larger cavities 26*a* projecting from the front surface of the front holder 31 are displaced along forward and backward directions FBD, and these displacements substantially correspond to those of the front surface of the male housing 1. Therefore, the corresponding front end surfaces are held substantially in contact when the male and female housings 1, 10 are connected properly.

The front holder 31 is mounted and the retainer 33 is held at the partial locking position prior to insertion of the terminal fittings 13*a*, 13*b* into the female housing 10. The signal terminal fittings 13*b* then are inserted into the smaller cavities 26*b* and contact the inner surface of the front wall of the front holder 31. Thus, the signal terminal fittings 13*b* are stopped at their front end positions and are locked by the locks 29*b*. Similarly, the power terminal fittings 13*a* contact the inner surface of the front wall of the corresponding larger cavity 26*a*. Accordingly, the power terminal fittings 13*a* are stopped at their front end positions and are locked by the corresponding locks 29*a*. At this time, the rear ends 22*b*-RE of the connecting portions 22*b* of the signal terminal fittings 13*b* and the rear ends 22*a*-RE of the connecting portions 22*a* of the power terminal fittings 13*a* substantially align, i.e. distances from a plane of opening of the outer tube portion 15 to these rear ends are substantially equal. Accordingly, the retainer 33 can be displaced from the partial locking position to the full locking position. Thus, the larger and smaller locking projections 37*a*, 37*b* of the locking sections 36*a*, 36*b* of the retainer 33 simultaneously engage the rear ends of the corresponding connecting portions 22*a*, 22*b*. As a result, all of the terminal fittings 13*a*, 13*b* are locked redundantly by the locks 29*a*, 29*b* and the locking projections 37*a*, 37*b*.

As described above, the respective terminal fittings 13*a*, 13*b* are held and retained in the female connector housing 10. At this time, the front ends of the signal terminal fittings 13*b* are slightly behind those of the power terminal fittings 13*a*. This displacement corresponds to the displacement between the leading ends of the tabs t1, t2 of the larger and smaller terminal fittings of the male connector. Thus, when the male and female housings 1, 10 are connected, all the terminal fittings 13*a*, 13*b* start contacting the corresponding tabs t1, t2 substantially at the same time, and the contact strokes of all the terminal fittings 13*a*, 13*b* are substantially equal.

The positions of the rear ends of the connecting portions 22*a*, 22*b* of the terminal fittings 13*a*, 13*b* substantially align in the connector for accommodating the terminal fittings 13*a*, 13*b* whose connecting portions 22*a*, 22*b* have different lengths. Thus, even if the arrangement of the larger and smaller terminal fittings 13*a*, 13*b* is changed, the terminal fittings 13*a*, 13*b* can be locked by the retainer 33. Therefore, a degree of freedom in the arrangement of the terminal fittings is improved.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the present invention is applied to the female connector in the foregoing embodiment, it may be applicable to male connectors.

Parts to be locked by the retainer may not necessarily be the rear ends of the connecting portions. For example, the connecting portions may be locked at their intermediate positions by the retainer.

According to the invention, either one of the locks or the retainer may lock the terminal fittings.

The invention is also applicable to connectors with no front holder.

Even though in the above described preferred embodiment the retainer locks a rear portion of the connection portions as a preferred lockable parts, the invention is applicable also to connectors or terminal fittings in which the retainer locks a different lockable part such as a locking projection, locking step or the like.

What is claimed is:

1. A connector, comprising:

a single integrally formed housing with a plurality of cavities arranged substantially along a width direction;

a plurality of kinds of terminal fittings that are insertable into the cavities, the terminal fittings having connecting portions of different lengths along forward and backward directions, lockable parts being defined on the connecting portions of the respective terminal fittings and being substantially aligned with one another along the forward and backward direction when the terminal fittings are inserted properly into the cavities; and a single intergrally formed retainer mountable into the housing along the width direction and being engageable with the lockable parts on the connecting portions of the terminal fittings that have been inserted properly into the respective cavities for retaining the terminal fittings in the cavities.

2. The connector of claim 1, wherein the housing comprises a plurality of locks for locking the respective terminal fittings in the respective cavities.

3. The connector of claim 2, wherein the locks have substantially crank shapes, a length of the locks at one side being shorter than at the other side along an inserting direction of the retainer and a thickness of the locks at one side being greater than at other side.

4. A connector assembly comprising the connector of claim 1 and a mating connector, wherein the terminal fittings are retained in the housing with front ends of the terminal fittings of one kind being displaced slightly behind those of the terminal fittings of the other kind, and wherein the displacement of the terminal fittings corresponds to a displacement between the leading ends of mating terminal fittings of the mating connector.

5. The connector assembly of claim 4, wherein one of the connector and the mating connector comprise a forcible connection preventing wall which projects from a main body and can interfere with the other of the connector and the mating connector when trying to connect the connector and the mating connector in an improper posture.

6. The connector of claim 1, the respective terminal fittings project from a front end surface of the housing different distances depending on the lengths of the connecting portions so that rear ends of the connecting portions substantially align with respect to an inserting direction of the terminal fittings, the rear ends defining the lockable parts.

7. The connector of claim 6, wherein the retainer can be positioned at a first position, where insertion and withdrawal of the terminal fittings to and from the respective cavities is permitted, and a second position, where the terminal fittings are locked in the respective cavities.

8. The connector of claim 6, further comprising a front holder mountable on the housing to define abutments for at least part of the cavities against which the terminal fittings can abut upon substantially proper insertion into the respective cavity.

9. The connector of claim 8, wherein an area of a front surface of the front holder corresponding to the cavities projecting from the front surface of the front holder is displaced along forward and backward directions.

10. A connector assembly, comprising:

a housing with a plurality of cavities arranged substantially along a width direction;

a plurality of kinds of terminal fittings that are insertable into the cavities, the terminal fittings having connecting portions of different lengths along forward and backward directions, lockable parts being defined on the connecting portions of the respective terminal fittings and being substantially aligned with one another along the forward and backward direction when the terminal fittings are inserted properly into the cavities;

a mating connector having a main body configured for connection with the housing, a forcible connection preventing wall provided on the main body of the mating connector and configured to interfere with the housing when trying to connect the housing and the mating connector in an improper poster; and a retainer mountable into the housing along the width direction and being engageable with the lockable parts on the connecting portions of the terminal fittings that have been inserted properly into the respective cavities for retaining the terminal fittings in the cavities, the retainer being formed with an insertion hole to permit insertion of the forcible connection preventing wall when the retainer locks the terminal fittings.

* * * * *